US006670879B2

(12) United States Patent
Carter et al.

(10) Patent No.: US 6,670,879 B2
(45) Date of Patent: Dec. 30, 2003

(54) TRANSFORMER CONTAINER

(76) Inventors: Edward Carter, 2935 Clifton Dr., Dyersburg, TN (US) 38024; Rad Hunsley, 126 Kist Ave., Dyersburg, TN (US) 38024; Jeffery Schneider, 90 Heathridge Dr., Dyersburg, TN (US) 38024

( * ) Notice: Subject to any disclaimer, the term of this patent is extended or adjusted under 35 U.S.C. 154(b) by 0 days.

(21) Appl. No.: 09/915,387

(22) Filed: Jul. 27, 2001

(65) Prior Publication Data

US 2003/0020581 A1 Jan. 30, 2003

(51) Int. Cl.[7] ..... H01F 27/02
(52) U.S. Cl. ..... 336/90; 336/65; 174/17 R
(58) Field of Search ..... 336/65, 90, 92, 336/94, 96; 174/17 R

(56) References Cited

U.S. PATENT DOCUMENTS 3,644,858 A * 2/1972 Galloway ..... 336/92

FOREIGN PATENT DOCUMENTS

JP 6-168828 * 6/1994

* cited by examiner

*Primary Examiner*—Tuyen T. Nguyen

(57) ABSTRACT

A transformer container comprising a transformer tank having a bottom, a front forward panel, two side panels, a rear panel and a top panel. The top panel forms a rim defining a portal for accessing to the interior of the transformer tank. The transformer tank is supported on a pad. A transformer sill is connected to and supported on the pad and is connected to the transformer tank adjacent the front panel. A transformer door is pivotally connected to the top panel of the transformer tank. The transformer door is supported on the transformer sill and may be locked thereto in a closed position. The transformer door, the pad and the transformer tank form an enclosure. The top panel of the transformer tank defines a plurality of holes. The front panel of the transformer tank is connected to the top panel of the transformer tank between the holes and the access portal, thus the holes communicate with the enclosure and not the interior of the transformer tank. The invention includes a transformer tank cover having a flange that extends below the rim and a plurality of threaded studs that extend through the holes defined by the top panel. Threaded nuts are used to engage the threaded studs to secure the transformer tank cover to the top panel of the transformer tank. The threaded studs and nuts may only be accessed by lifting the transformer door which is normally locked in a closed position by a locking mechanism seated within the transformer sill.

12 Claims, 7 Drawing Sheets

TRANSFORMER CONTAINER

FIELD OF THE INVENTION

This invention relates to containers for enclosing a transformer mounted on a pad. More particularity the present invention relates to transformer containers having a transformer tank and a transformer door pivotally connected to the tank and detachably locked to a transformer. In greater particularity, the present invention relates to padmounted transformer containers having a transformer tank cover detachably connected to the transformer tank for covering an access portal defined thereby.

BACKGROUND OF THE INVENTION

Distribution transformers are used to reduce the voltage from the power lines, that are used to distribute power, to a voltage that is safe to use by the end user (typically a home or business). With the progressive use of underground power lines, the use of pad mounted transformers has become more common. The pad mounted transformer is typically attached to and is supported by a concrete pad or a pad made of other materials with similar durability. The transformer enclosure has two basic components, the wiring compartment that contains the connections for the power distribution system and the tank that contains the transformer's core and coil assembly immersed in oil. Electrical connections extend from the core and coil through a front panel of the transformer tank into the wiring compartment enabling connection to the power distribution system.

The wiring compartment is accessed by a door, which is connected at a pivot point on the oil compartment tank and, in combination with the transformer tank, forms the complete enclosure wherein the transformer is housed. The door is secured by a bolt and by a padlock, limiting access to authorized personnel only. The tank oil compartment is a sealed container, which houses the core and coil assembly and the oil. Typically the oil compartment is of welded construction, including a cover that is welded into place forming a completely welded container. Although the welded tank and cover provides a good oil compartment, it is difficult to gain entry to the tank to perform repairs, change fuses and allow inspections.

One of the primary functions of the transformer enclosure is to prevent access to the transformer by unauthorized individuals. Accordingly, the transformer cover door is typically locked to the transformer pad. The door may utilize a lock as simple as a pad lock. More common is the use of a transformer sill bolted to the transformer pad and supporting the transformer door which is pivotally connected to the transformer tank. The transformer sill houses a locking mechanism which may be used to selectively engage and lock the transformer door to the transformer sill.

As stated above, it would be convenient if the interior of the transformer tank could be periodically accessed to perform maintenance inspection. Since transformer tanks are commonly designed with a welded cover, easy access to the interior of the transformer tank is not possible. To prevent authorized access, the transformer tank will include a removable transformer tank cover which blocks unauthorized access to the interior of the transformer tank.

In U.S. Pat. No. 4,533,786 issued to Borgmeyer et al., the tank cover is a flat sheet of steel(124) welded to the tank. Obviously, access to the tank would require a cutting torch. A similar arrangement is shown in U.S. Pat. No. 4,559,699 issued to Owen, et al.

There are transformer tank covers that are secured using a series of bolts connected to the tank and extending through a plurality of holes defined in the transformer tank cover. See U.S. Pat. No. 3,376,086 issued to J. L. Fisher. The transformer tank cover is secured to the transformer tank with a plurality of threaded bolts and nuts. To prevent unauthorized users from removing the nuts, a false cover may be pivotally mounted to the transformer tank cover and those bolts associated therewith. The false cover is then locked to the transformer tank. It should be apparent; however, that the false cover adds additional manufacturing cost and additional removal time to access the interior of the tank.

What is needed is a transformer container having a transformer tank cover thereon which will prevent unauthorized access to the transformer tank interior and at the same time, facilitate ease of manufacture and minimize manufacturing costs and limit the time necessary for authorized access to the interior of the tank.

SUMMARY OF THE INVENTION

The present invention includes a transformer tank having a front panel, two side panels and a rear panel all connected to a bottom. The transformer tank is connected to and supported by a pad. The transformer tank also includes a top panel having a rim that defines a portal through which the interior of the tank may be accessed. One or more holes are defined by the top panel proximate a rearward edge thereof. Note that the rear panel is connected to the top panel between the holes and the portal such that the holes do not communicate with the interior of the tank. A transformer cover sill is bolted to the pad and to the transformer tank and has a locking mechanism seated therein. A transformer door is pivotally connected to the top panel of the transformer tank and may be pivoted to a closed position in contact with the transformer sill and selectively locked thereto by the locking mechanism. The transformer door, the transformer sill, the pad and the transformer tank form a lockable enclosure with which the holes defined by the top panel communicate.

The present invention also includes a transformer tank cover having a flange thereon for engaging a portion of the rim opposite the holes. The flange is substantially "U" shaped in cross-section; having a first member that extends from an underside of the cover, a second portion connected to the first portion and extending substantially parallel to the cover past a lateral edge thereof, and a third portion connected to the second portion and extending upward in substantially parallel relation to the first portion. The third portion defines an engaging edge that is spaced in substantially parallel relation to the lateral edge of the transformer tank cover. The engaging edge is spaced laterally of the transformer tank cover a distance greater than the thickness of the rim; however, if the transformer cover was supported on a horizontal plane, the engaging edge would be spaced below the lateral edge of the transformer cover a distance substantially equal to the width of the rim.

Note that this particular arrangement of the flange and the engaging edge relative to the lateral edge of the transformer tank cover facilitates the insertion of the engaging edge below the rim while the lateral edge of the transformer tank cover is positioned above the rim with the rim therebetween. The transformer tank cover may then be lowered to a closed position in contact with the top panel with the rim engaged between the lateral edge of the transformer tank cover and the engaging edge of the flange and in substantially pressed abutmant with both. The flange thus partially secures the transformer tank cover to the top panel of the transformer tank. The transformer tank cover also includes one or more threaded studs connected to an underside of the transformer tank cover. The threaded studs extend substantially perpendicular to the transformer tank cover for reception within and extension through the holes defined in the top panel of the transformer tank. A gasket is secured to the transformer tank cover and creates a seal between the transformer tank cover and the top panel. The gasket is positioned inward of the lateral edge of the transformer tank cover to prevent tampering.

In operation the transformer tank cover is tilted in angular relation to the top panel of the transformer tank, the flange is positioned beneath the rim and the transformer tank cover is rotated downward in substantially coplaner contact with the top panel of the transformer tank. The threaded studs are received through the holes as the transformer tank cover comes to rest on the top panel. The transformer cover hood is lifted to allow access to the threaded stud. A plurality of threaded nuts are used to threadably engage a threaded end of each post to secure the transformer tank cover to the top panel of the transformer tank. The transformer tank hood is then closed and locked to prevent access, not only to the power distribution system contained therein, but also the nuts and threaded studs securing the transformer tank cover.

The foregoing invention provides a transformer tank container that is simple and inexpensive to manufacture that utilizes a transformer tank cover that may be easily secured to the transformer tank and which, in combination with the specific arrangement of the front panel of the transformer tank, and its positioning between the holes and the portal defined on the top panel of the transformer tank, will prevent access by an unauthorized individual. No additional locking mechanism is required other than that commonly used to secure the transformer door to the transformer sill.

BRIEF DESCRIPTION OF THE DRAWINGS

Apparatus and embodying features of the invention are depicted in the accompanying drawings which form a portion of this disclosure and wherein.

DESCRIPTION OF A PREFERRED EMBODIMENT

Figure 1:
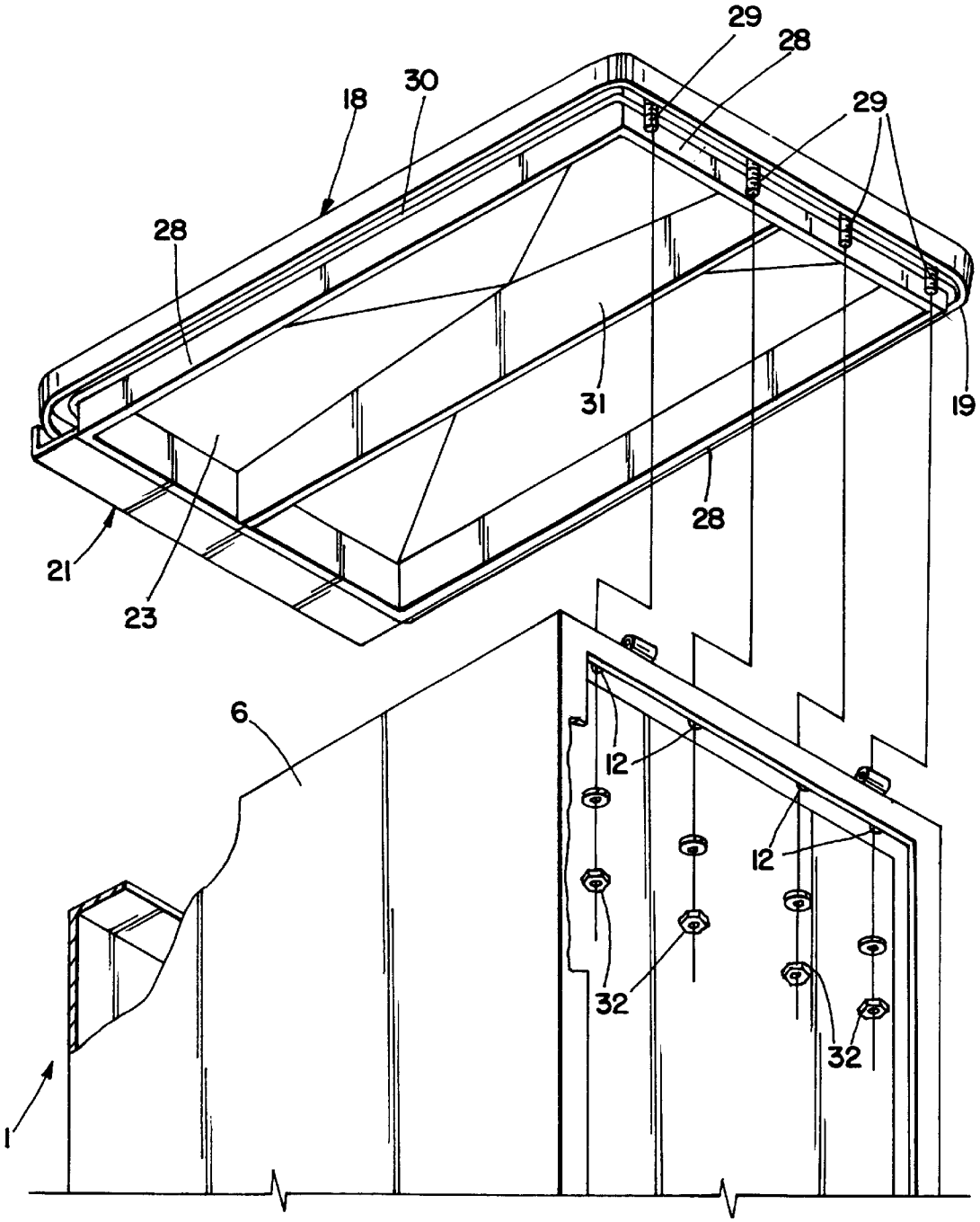
FIG. 1. is an exploded perspective view of the present invention.
Figure 2:
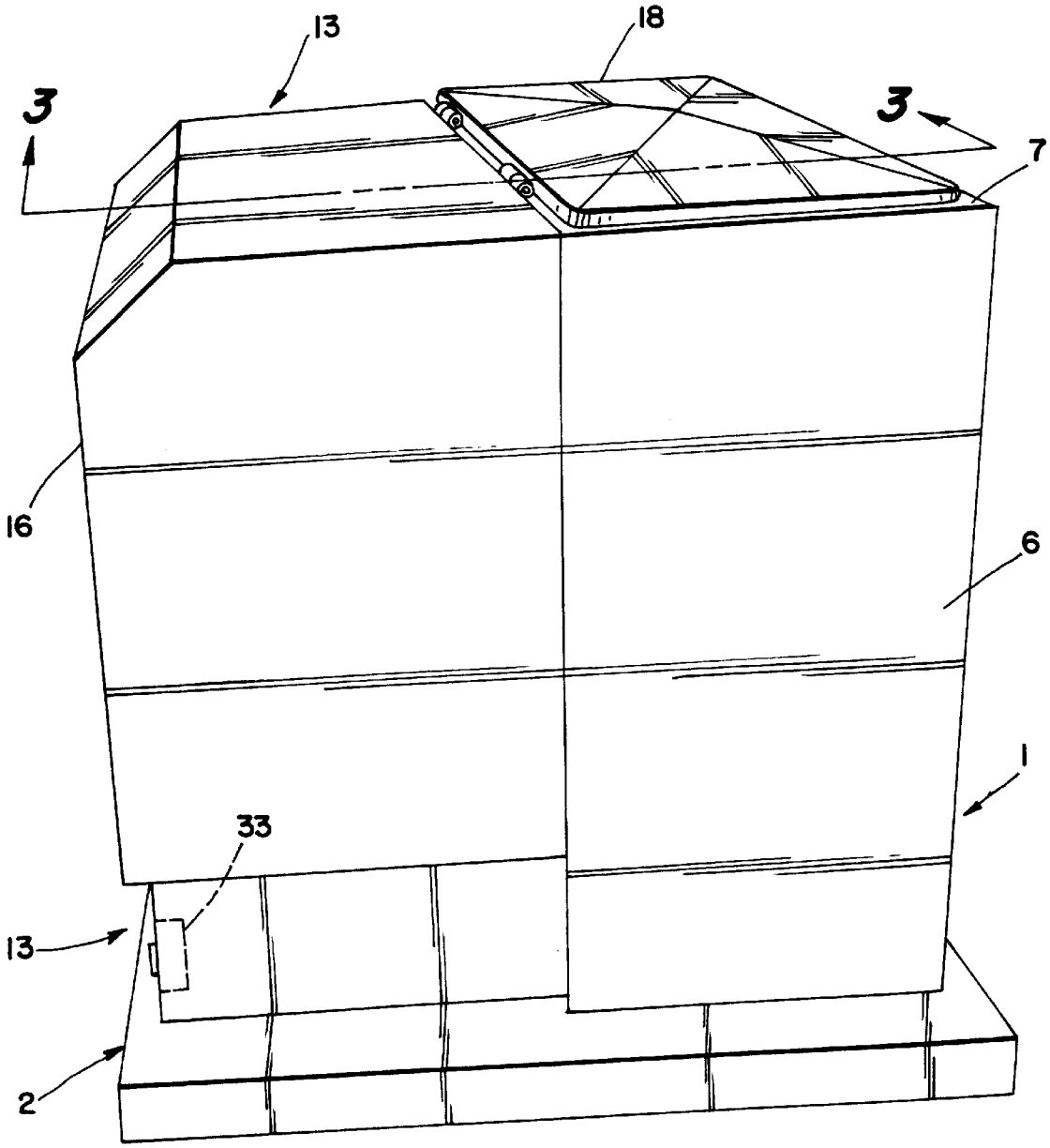
FIG. 2. is a perspective view of the present invention with the transformer tank cover attached and with the transformer cover hood in a closed and locked position.

Referring to the drawings for a clearer understanding for the present invention, it should be noted that FIGS. 1–9, that the present invention contemplates the use of a transformer tank 1 connected to and supported by a pad 2. The transformer tank 1 includes a bottom 3 and a front panel 4 connected to the bottom 3 and extending vertically therefrom. Two side panels 6 are connected to the bottom 3 and the front panel 4 on opposite sides thereof. A top panel 7 is connected to the front panel 4 and the side panels 6 opposite the bottom 3. A rear panel 8 is connected to the side panels 6, the bottom 3 and the top panel 7.

Figure 3:
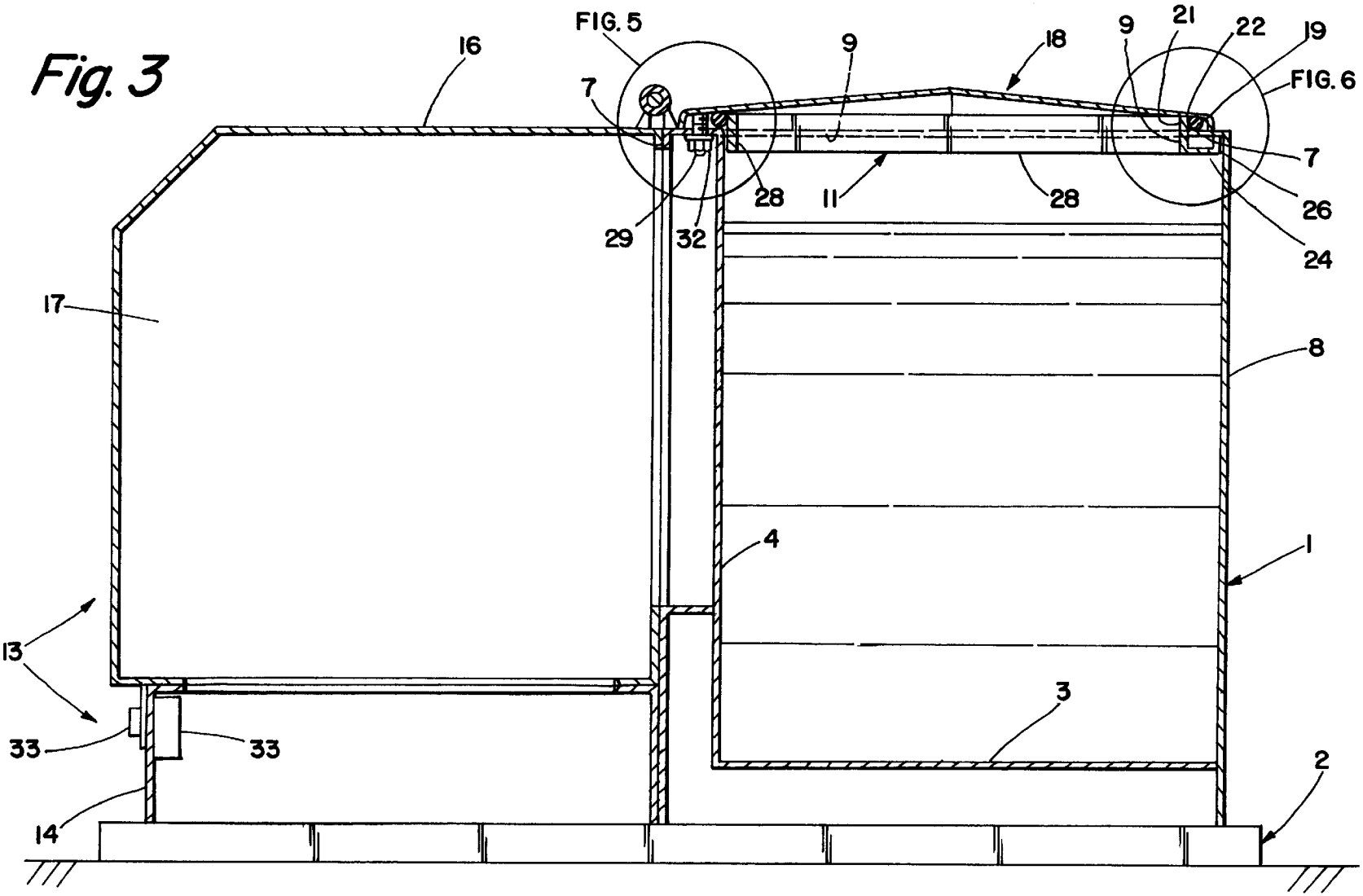
FIG. 3. is a cross-sectional view taken along line 3—3 in FIG. 2.
Figure 4:
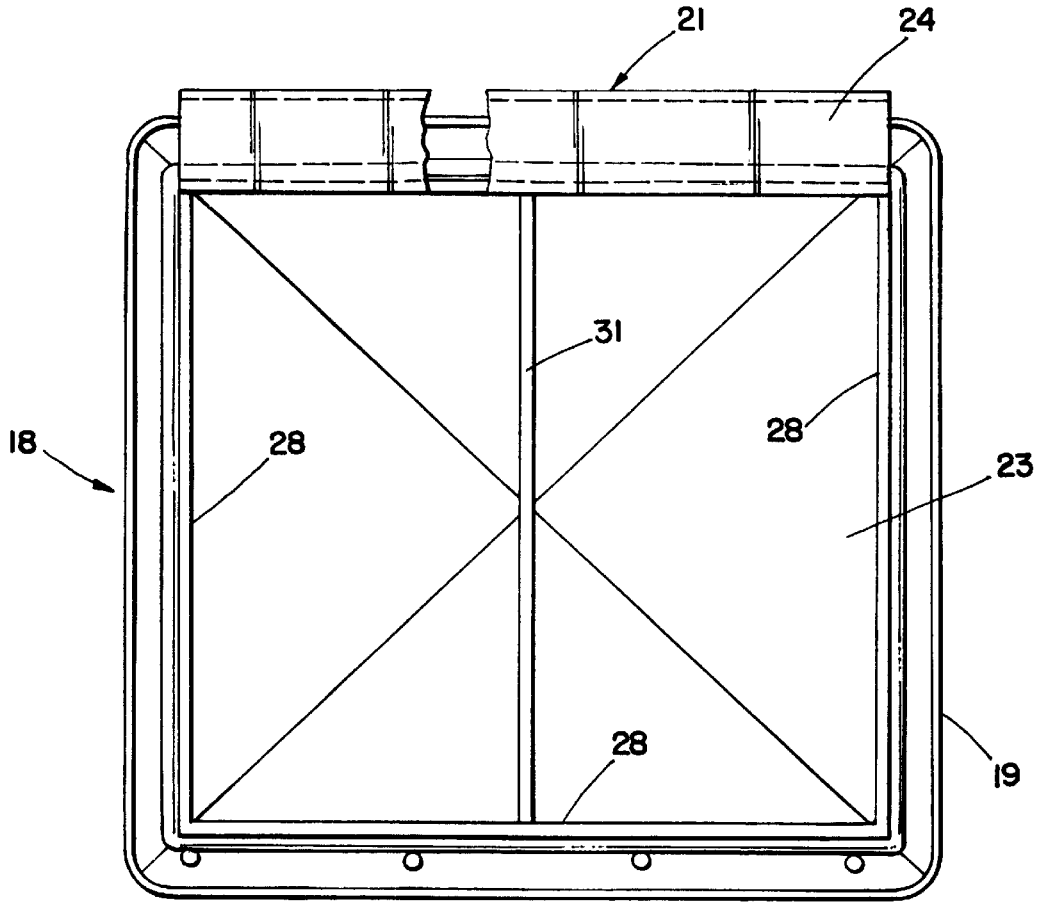
FIG. 4. is a bottom view of the transformer tank cover.
Figure 5:
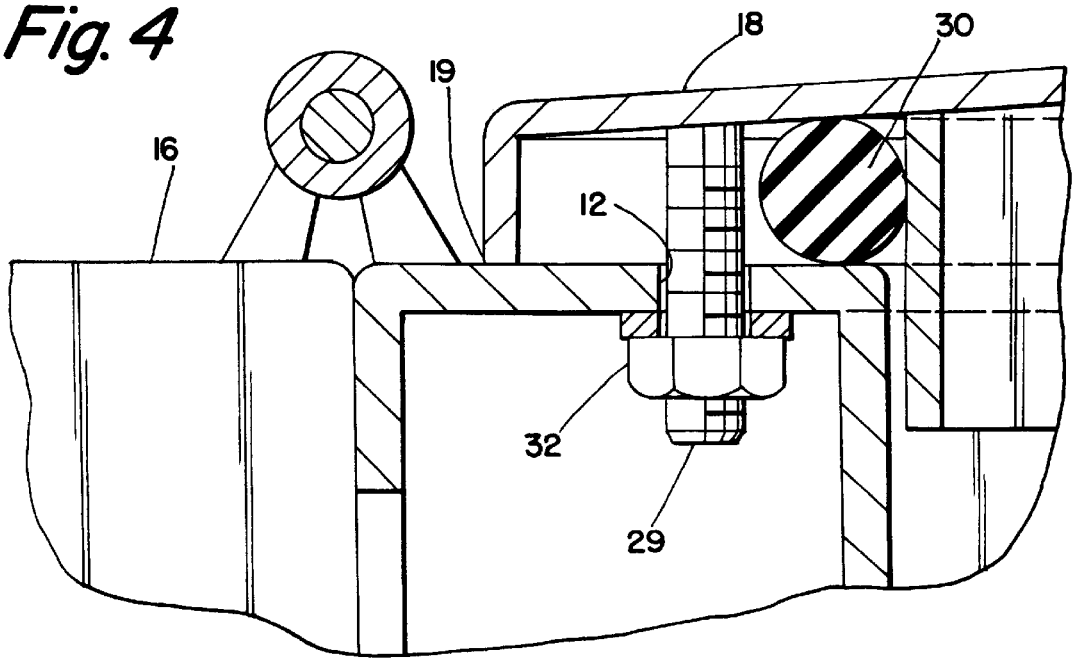
FIG. 5. is a first detailed view taken from FIG. 3.

The top panel 7 forms a rim 9 which defines a portal 11 for accessing the interior of the transformer tank 1. A plurality of holes 12 are defined by the top panel 7 proximate the front panel 4. As shown in FIGS. 3 and 5, the front panel 4 is positioned between the holes 12 and the portal 11 thus isolating the holes 12 from the interior of the transformer tank 1.

A transformer cover 13 is supported on the pad 2 and includes the transformer sill 14 connected to and supported by the pad 2. The transformer sill 14 is also connected to the transformer tank 1. A transformer door 16 is pivotally connected to the top panel 7 of the transformer tank 1 and; in combination with the transformer sill 14, the pad 2 and the transformer tank 1, forms an enclosure 17 in which the transformer power distribution system (not shown) may be housed. Note that the holes 12 are in communication with the enclosure 17.

Though not shown, the front panel 4 of the transformer tank 1 has one or more inserts allowing the insertion of electrical conduit through the front panel so that a transformer core and coil (not shown) seated within the transformer tank 1 may be conductively connected to the power distribution system (not shown) that is supported on the pad 2 within the enclosure 17.

Figure 6:
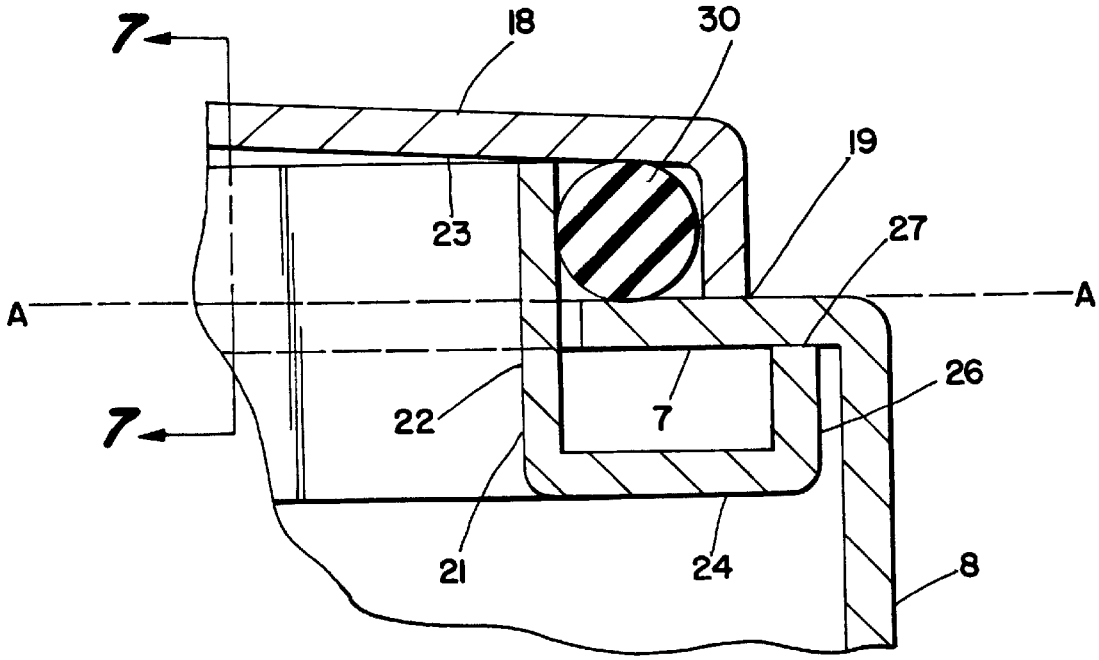
FIG. 6. is a second detailed view taken from FIG. 3.
Figure 7:
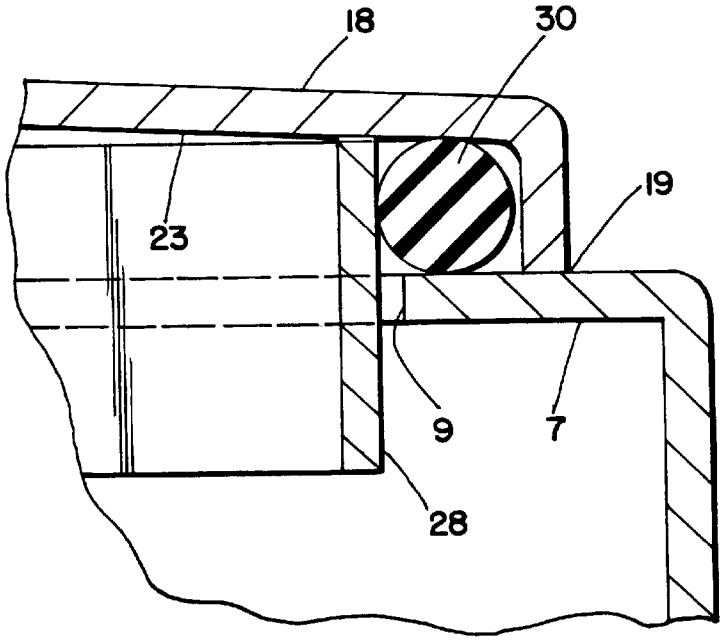
FIG. 7 is a cross-sectional view taken along line 7—7 of FIG. 6.

The invention also includes a detachable transformer tank cover 18. The transformer tank cover is substantially flat having a downwardly curved lateral edge 19. A flange 21 is connected to the transformer tank cover 18 in spaced relation to the lateral edge 19. In the preferred embodiment, the transformer tank cover 18 is substantially rectangular and the flange 21 co-extends one side thereof in spaced relation to the lateral edge 19. As shown in FIG. 6 the flange includes a first portion 22 connected to an underside 23 of the transformer tank cover 18. The first portion 22 extends substantially perpendicular to the transformer tank cover 18. The flange 21 includes a second portion 24 connected to the first portion 22 and extending therefrom in substantially parallel relation to the transformer tank cover 18 and past the lateral edge 19 thereof. A third portion 26 is connected to the second portion 24 and extends therefrom in substantially parallel relation to the first portion 22. The third portion 26 defines an engaging edge 27 that is spaced in substantially parallel co-extensive relation to the lateral edge 19 of the transformer tank cover 18. The engaging edge 27 is spaced from an imaginary plane, shown as line A—A in FIG. 6, a distance substantially equal to the thickness of the top panel 7. The transformer tank cover 18 also includes a positioning flange 28 which is connected to the underside 23 of the transformer tank cover 18 in substantially perpendicular relation thereto. The positioning flange 28 is also connected to the first portion 22 of the flange 21 and extends therefrom in spaced relation to the lateral edge 19.

The transformer tank cover 18 also includes a plurality of threaded studs 29 that are connected to the underside 23 of the transformer tank cover 18 and extend therefrom in substantially perpendicular relation thereto. A cross-member 31 is connected to the positioning flange 28 and to the flange 21 to provide structural support. A gasket 30 is connected to the underside 23 of the transformer tank cover 18 and forms a seal between the transformer tank cover 18 and the top panel 7 when the transformer tank cover 18 is supported thereon.

Figure 8:
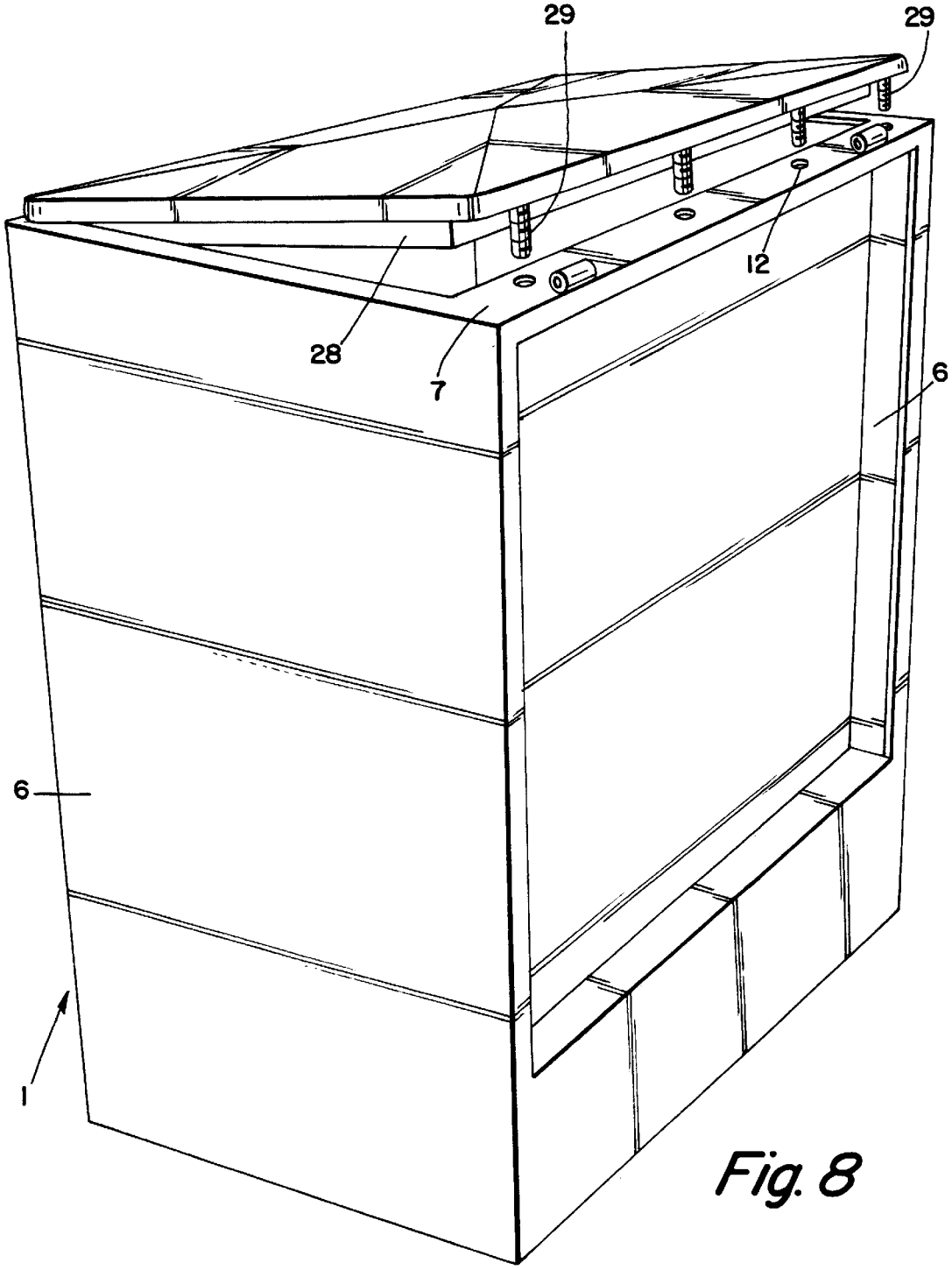
FIG. 8. Is a perspective view of the transformer tank with the transformer tank cover ajar.
Figure 9:
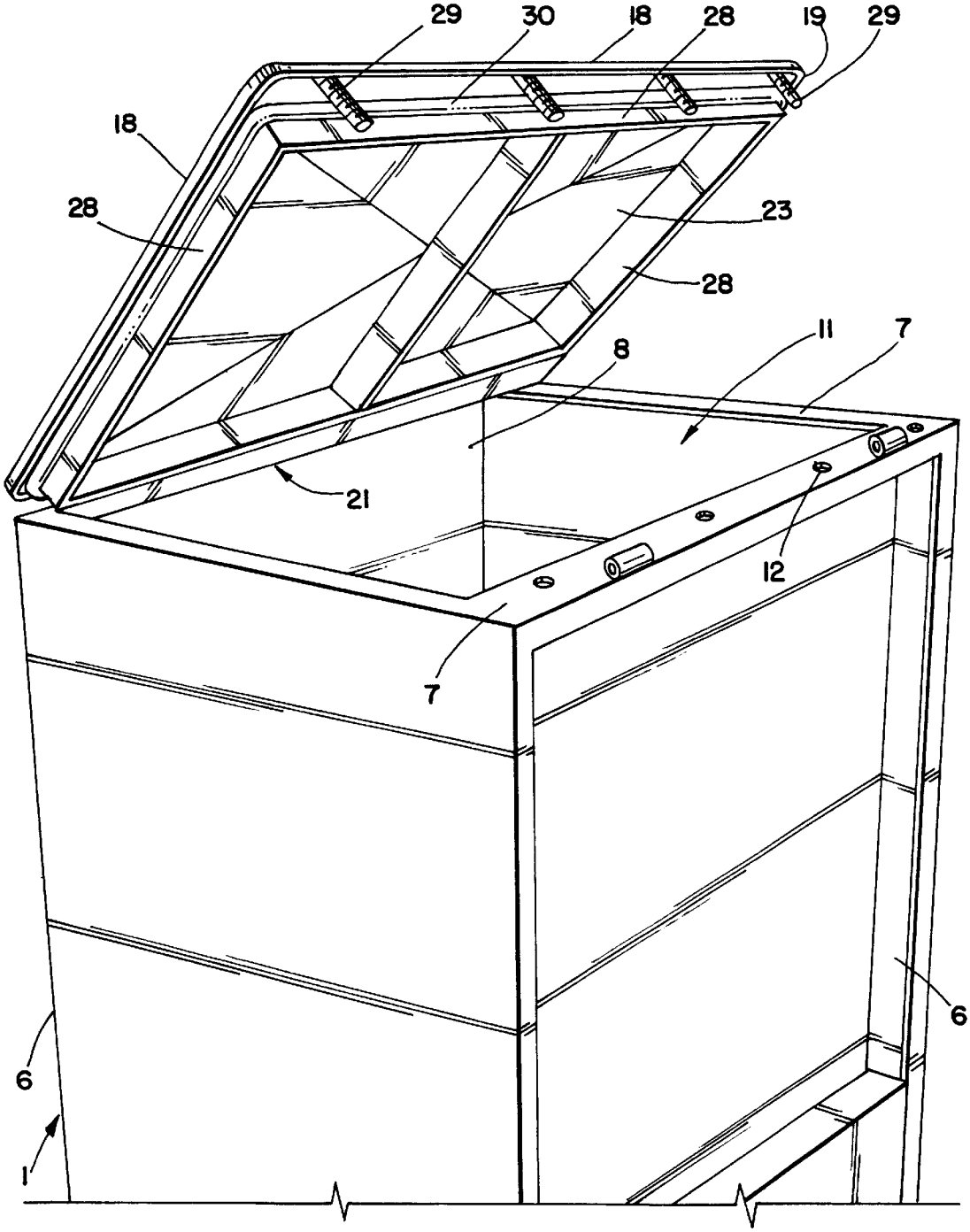
FIG. 9. is a perspective view of the transformer tank with the transformer tank cover raised upward to an open position.

In operation, the transformer tank cover 18 is partially secured to the transformer tank 1 by tilting the transformer tank cover 18 in angular relation to the top panel 7. As is shown in FIGS. 6 and 9, the third portion 26 is slipped beneath the rim 9 of the top panel 7 with the rim 9 thus passing between the engaging edge 27 of the third portion 26 and the lateral edge 19 of the transformer tank cover 18. As the user slides the flange 21 beneath the rim 9, the user will lower the transformer tank cover downward until it rests in contact with the top panel 7. As shown in FIGS. 1,5 and 8, the threaded studs 29 are received by and extend through the holes 12. The user may then lift the transformer door 16 upward from the transformer sill to access the threaded studs 29. The threaded studs 29 each receive one of a plurality of threaded nuts 32 which threadably engage the posts 29 and, when tightened against the top panel 7, secure the transformer tank cover 18 to the transformer tank 1. The transformer door 16 may then be lowered and locked to the transformer sill 14 by a locking mechanism 33 seated within the transformer sill 14.

While I have shown my invention in one form, it will be obvious to those skilled in the art that it is not so limited but is susceptible of various changes and modifications without departing from the spirit thereof.

We claim:

1. A transformed container compromising:

(a) A transformed tank connected to and supported by a pad and having a substantially planer and horizontally situated upper rim formed thereon that defines a portal for accessing the interior of said transformer tank;

(b) A transformer tank cover capable of being supported on said rim and across said portal in a closed position to block access to the interior of said transformer tank; and (c) a flange connected to an underside of said transformer tank cover proximate a lateral edge thereof and extending through said portal and beneath said rim such that said horizontally situated rim is received between and in pressed abutment with said flange and said transformer tank cover when said transformer tank cover is in said closed position, wherein said flange restricts the upward movement of said lateral edge of said transformer tank cover from said upper rim of said transformer tank.

2. A transformer container as described in claim 1 wherein said flange comprises:

(a) a first portion connected to said underside of said transformer tank cover in spaced, substantially parallel relation to said lateral edge and substantially perpendicular relation to said underside of said cover;

(b) a second portion connected to said first portion in substantially perpendicular relation thereto and extending laterally therefrom outward of said lateral edge of said cover; and (c) a third portion connected to said second portion opposite said first portion and in substantially spaced relation thereto such that said third portion defines an engaging edge substantially parallel to and laterally outward of said lateral edge of said cover.

3. A transformer container as described in claim 1 further comprising means, connected to said underside of said transformer tank cover and extending through one or more holes defined by said rim, for detachably securing said transformer tank cover to said rim when said transformer tank cover is in said closed position.

4. A transformer container as described in claim 3 wherein said securing means comprises one or more threaded studs connected to said underside of said transformer tank cover and extending therefrom in substantially perpendicular relation thereto and one or more threaded nuts, each capable of threadably engaging one of said threaded studs, each said nut having a diameter greater than the diameter of each of said holes.

5. A transformer container as described in claim 1 further comprising a positioning flange connected to said underside of said transformer tank cover in substantially perpendicular relation thereto and in spaced relation to said lateral edge wherein said positioning flange is received within said portal in close co-extending proximity to said rim when said transformer tank cover is in said closed position.

6. A transformer container as described in claim 4 further comprising a transformer cover having a transformer door pivotally connected to said transformer tank and means mounted to said pad for selectively locking said transformer door to said pad, wherein said transformer door, when locked to said pad forms an enclosure with said locking means, said pad and said transformer tank to prevent access to said nuts.

7. A transformer container comprising:

(a) a transformer tank, connected to and supported by a pad, and having in upper rim formed thereon that defines a portal for accessing the interior of said transformer tank;

(b) a transformer door pivotally connected to said transformer tank to form an enclosure therewith when said transformer door is pivoted to a locked position in contact with a transformer sill connected to and supported on said pad;

(c) a plurality of holes defined by said transformer tank proximate said portal and in communication with said enclosure;

(d) a transformer tank cover supported on said transformer tank and extending across and covering said portal and said holes;

(e) a flange connected to said transformer tank cover and extending beneath said rim to partially secure said transformer tank cover to said transformer tank; and (f) means connected to said transformer tank cover and extending through said holes for securing said transformer tank cover to said transformer tank, wherein said securing means cannot be accessed when said transformer door is in said locked position.

8. A transformer container as described in claim 7 wherein said transformer tank comprises:

(a) a bottom;

(b) a rear panel connected to said bottom and extending vertically therefrom;

(c) two side panels connected to said bottom and said rear panel on opposite sides thereof;

(d) a top panel connected to said rear panel and said side panels and forming said rim and defining said holes; and (e) a front panel connected to said bottom panel, said top panel and said side panels and wherein said front panel is connected to said top panel between said holes and said portal thus isolating said holes from said interior of said transformer tank.

9. A transformer container as described in claim 7 wherein said securing means comprises one or more threaded studs connected to said underside of said transformer tank cover and extending therefrom in substantially perpendicular relation thereto and one or more threaded nuts, each capable of threadably engaging one of said threaded studs, each said nut having a diameter greater than the diameter of each of said holes.

10. A transformer container comprising:

(a) a transformer tank supported on a pad and having a top panel defining a portal and plurality of holes;

(b) a transformer door pivotally mounted to the transformer tank and supported on the pad to form an enclosure wherein said holes are in communication with said enclosure; and (c) a transformer tank cover having a flange connected thereto for engaging said top panel and partially securing said cover thereto and a plurality of studs connected to said transformer tank cover and received through said holes and secured therein by a plurality of nuts threadably connected to said studs, wherein said nuts are accessible only by pivoting said transformer door upward from said pad.

11. A transformer container as described in claim 10 further comprising means connected to said pad for selectively locking said transformer door to said pad.

12. A transformer container as described in claim 11 wherein said locking means comprises a transformer sill, connected to said pad and to said transformer tank, and having a locking mechanism seated therein for engaging and locking said transformer door to said transformer sill, wherein said transformer sill supports said transformer door in a closed position.

* * * * *